US007232632B2

(12) United States Patent
Kondou et al.

(10) Patent No.: US 7,232,632 B2
(45) **Date of Patent: *Jun. 19, 2007**

(54) COLOR TONERS AND IMAGE FORMING METHOD USING THE COLOR TONERS

(75) Inventors: Tomio Kondou, Numazu (JP); Shinichi Kuramoto, Numazu (JP); Hideki Sugiura, Fuji (JP)

(73) Assignee: Ricoh Company, Ltd, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/845,449

(22) Filed: Apr. 30, 2001

(65) Prior Publication Data

US 2002/0006564 A1 Jan. 17, 2002

(30) Foreign Application Priority Data

May 2, 2000 (JP) ..... 2000-133980

(51) Int. Cl.
*G03G 13/01* (2006.01)

(52) U.S. Cl. ..... 430/45; 430/47; 430/107.1; 430/108.23; 430/108.24; 430/108.3; 430/109.2; 430/111.4

(58) Field of Classification Search ..... 430/45, 430/47, 124, 107.1, 108.23, 109.2, 108.3, 430/111.4, 108.24; 399/223, 227, 299, 302, 399/303, 321, 335, 336, 325
See application file for complete search history.

(56) References Cited

U.S. PATENT DOCUMENTS

| | | | | |
|---|---|---|---|---|
| 3,874,892 | A * | 4/1975 | McInally | 430/124 |
| 4,593,991 | A * | 6/1986 | Aoki et al. | |
| 5,188,929 | A | 2/1993 | Ishii | |
| 5,262,264 | A | 11/1993 | Shimizu et al. | |
| 5,442,428 | A * | 8/1995 | Takahashi et al. | |
| 5,521,688 | A * | 5/1996 | Moser | 219/216 |
| 5,554,478 | A | 9/1996 | Kuramoto et al. | |
| 5,805,969 | A * | 9/1998 | Elsermans et al. | 399/321 |
| 6,020,100 | A * | 2/2000 | Iwasaki et al. | |
| 6,188,418 | B1 * | 2/2001 | Hata | 399/302 |
| 2002/0192580 | A1 * | 12/2002 | Kuramoto et al. | 430/45 |

FOREIGN PATENT DOCUMENTS

| | | | |
|---|---|---|---|
| DE | 19534384 | | 4/1996 |
| EP | 0862090 | | 9/1988 |
| JP | 9171268 | | 6/1997 |
| JP | 9171269 | | 6/1997 |
| JP | 2000-199982 | * | 7/2000 |

OTHER PUBLICATIONS

Japanese Patent Office Machine-Assisted Translation of JP 2000-199982 (Pub Jul. 2000).*

CAS File Registry No. 77804-81-0.*

CAS File Registry No. 147-14-8.*

Herbst, Willy, & Klaus Hunger, *Industrial Organic Pigments*, 2nd Edition, John Wiley & Sons(1997), pp. 289, 307, 308.*

USPTO English-language translation of JP 12-199982 (pub. Jul. 18, 2000).*

U.S. Appl. No. 09/434,472, filed Nov. 5, 1999, Kuramoto et al.

Patent Abstracts of Japan, Abstract of Published Japanese Patent Application No. 02 066562A (Jun. 3, 1990).

Patent Abstracts of Japan, Abstract of Published Japanese Patent Application No. 03 107869A (Aug. 5, 1991).

Patent Abstracts of Japan, vol. 017, No. 293 (p. 1550), Jun. 4, 1993, abstract of JP 05 19536A, Jun. 1993, Japan.

Database WPI, Sec. Ch, Week 199921, Derwent, class A89, AN 1999-249741, XP002173830, abstract of JP11 073025A, Mar. 1999, Japan.

Database WPI, Sec. Ch, Week 200065, Derwent, class E24, AN 2000-667025, XP-002173831, abstract of JP 2000 199982A, Jul. 2000, Japan.

* cited by examiner

*Primary Examiner*—Janis L. Dote
(74) *Attorney, Agent, or Firm*—Cooper & Dunham LLP

(57) ABSTRACT

A method for forming a full color image including: forming at least yellow, magenta and cyan color toner images on a receiving material to form a full color image thereon; and fixing the full color image upon application of heat thereto while not contacting the full color image, wherein each of the yellow, magenta and cyan color toner images includes a binder resin and a pigment, wherein the yellow color toner includes a benzimidazolone pigment, the magenta color toner includes at least one of Naphthol Carmine F6B and a combination of Naphthol Carmine F6B and Naphthol Carmine FBB, and the cyan color toner includes β copper phthalocyanine, and wherein the yellow color toner image has a position closer to the receiving material than any other color toner image when two or more of the color toner images including the yellow color toner image are overlaid.

6 Claims, 4 Drawing Sheets

COLOR TONERS AND IMAGE FORMING METHOD USING THE COLOR TONERS

BACKGROUND OF THE INVENTION

1. Field of the Invention

The present invention relates to color toners and an image forming method using the color toners. More particularly, the present invention relates to yellow, magenta, and cyan toners which are used for forming color images using electrophotography, and to an image forming method using the color toners and a non-contact heat fixing method.

2. Discussion of the Background

Image forming methods using electrophotography are well known. Various color toners for the image forming methods have been proposed. For example, Japanese Laid-Open Patent Publication No. 9-171268 discloses color toners including a cyan toner including β phthalocyanine, a magenta toner including Rhodamine 6G xanthenesilicomolybdate, a yellow toner including a benzidine type pigment, and a black toner including carbon black. Japanese Laid-Open Patent Publication No. 9-171269 discloses color toners including a cyan toner including β phthalocyanine, a magenta toner including monoazo Lithol Rubine, a yellow toner including a benzidine type pigment, and a black toner including carbon black. These color toners can produce red images having good tint, i.e., having good color reproducibility, however, the color tone of a bluish violet color image produced by them is not satisfactory.

Japanese Laid-Open Patent Publications Nos. 2-66562 and 3-107869 have disclosed quinacridone type pigments as a colorant for a magenta toner. The tint of bluish violet color images is good, however the toners have a drawback in that the color tone of a red image is not satisfactory.

In addition, a benzidine type yellow pigment, Pigment Yellow 17, is typically used for yellow toners because of having good tint and transparency, however, the light resistance (in particular the resistance to sunlight) of the pigment is not good. Therefore green color images which are a combination of the yellow pigment with a cyan toner are easily changed to bluish green when the green color images are exposed to light.

Thus, it is difficult to form color toner images having good color reproducibility (i.e., to form color toner images whose colors are well balanced). In particular, it is difficult to reproduce color images having a good combination of red color reproducibility and blue color reproducibility. These problems concerning color reproducibility are prominent in the color images which are fixed with a non-contact type heat fixing method using an oven and the like rather than a heat roller fixing method. In addition, the color toner images generally have poor light resistance as mentioned above.

Because of these reasons, a need exists for color toners which can produce color images having good color reproducibility. In particular, a need exists for color toners which can produce color images having a good combination of red color reproducibility and blue color reproducibility, and good light resistance even when used for non-contact heat fixing methods.

SUMMARY OF THE INVENTION

Accordingly, an object of the present invention is to provide an image forming method in which color images having a good combination of red color reproducibility and blue color reproducibility, and good light resistance can be produced in particular when the toner images are fixed by a non-contact fixing method.

Another object of the present invention is to provide color toners which can produce color images having a good combination of red color reproducibility and blue color reproducibility.

Yet another object of the present invention is to provide color toners which can produce color images having good light resistance.

To achieve such objects, the present invention contemplates the provision of a method for forming a full color image which includes the steps of forming at least a yellow color toner image, a magenta color toner image and a cyan color toner image on a receiving material to form a full color image thereon, and fixing the full color toner image upon application of heat thereto while not contacting the full color toner image, wherein each of the color toner images includes a binder resin and a pigment, wherein the yellow color toner includes a benzimidazolone, the cyan color toner includes β phothalocyanine, and the magenta color toner includes at least one of Naphthol Carmine F6B and a combination of Naphthol Carmine F6B and Naphthol Carmine FBB, as the pigment, and wherein the yellow color toner image has a position closer to the receiving material than any other color toner image when two or more of the color toner images including the yellow color toner image are overlaid.

Each of the fixed yellow, magenta or cyan toner images preferably has a haze factor not greater than 20% when the fixed toner image has a weight of 8 g/m$^2$. In addition, each of the yellow, magenta or cyan toners preferably has a melt viscosity not greater than 120 mPas·sec at 140° C.

Further each of the color toners preferably includes as the binder resin a polyol resin having a polyoxyalkylene moiety in its main chain. The polyol resin is preferably a reaction product of: (a) an epoxy resin; (b) a dihydric phenol; and either (c) an adduct of a dihydric phenol with an alkylene oxide or (c') a glycidyl ether of an adduct of a dihydric phenol with an alkylene oxide.

Each of the color toners preferably includes a charge controlling agent having the following formula (1):

(1)

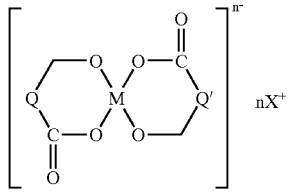

wherein Q and Q' independently represent an aromatic oxycarboxylic acid group which may substituted by an alkyl group or an aralkyl group; X represents a counter ion; and M represents a metal. The metal is preferably zinc or chromium.

In another aspect of the present invention, a set of color toners for a non-contact heat fixing method is provided which includes at least a yellow toner, a magenta toner and a cyan toner, wherein the yellow toner includes a benzimidazolone, the cyan toner includes β phothalocyanine, and the magenta toner includes at least one of Naphthol Carmine F6B and a combination of Naphthol Carmine F6B and Naphthol Carmine FBB, as the pigment.

These and other objects, features and advantages of the present invention will become apparent upon consideration of the following description of the preferred embodiments of the present invention taken in conjunction with the accompanying drawings.

DETAILED DESCRIPTION OF THE INVENTION

Figure 1:
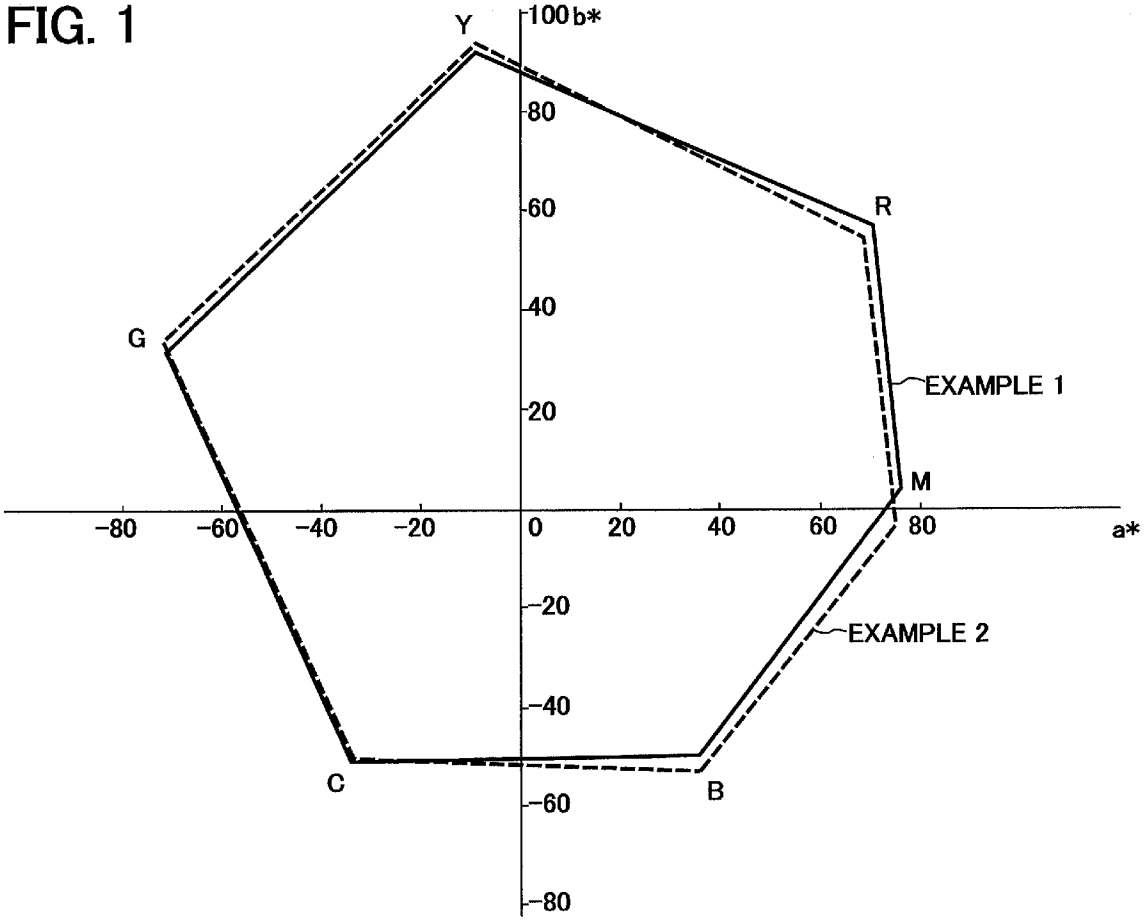
FIGS. 1-3 are graphs of a*-b* chromaticity coordinates in which hexagons are formed by the respective six points of the color images prepared in Examples 1 to 4 and Comparative Examples 1 to 3.

The present invention provides a method for forming a full color image which includes the steps of forming at least a yellow color toner image, a magenta color toner image and a cyan color toner image on a receiving material to form a full color image thereon, and fixing the full color image upon application of heat thereto while not contacting the full color image, wherein each of the color toners includes a binder resin and a pigment, wherein the yellow color toner includes a benzimidazolone, the cyan color toner includes β phothalocyanine, and the magenta color toner includes at least one of Naphthol Carmine F6B and a combination of Naphthol Carmine F6B and Naphthol Carmine FBB, as the pigment, and wherein the yellow color toner image has a position closer to the receiving material than any other color toner image when two or more color toner images including the yellow color toner image are overlaid.

When used for a roller fixing method, such a color toner combination as mentioned above can produce color images having a good combination of red color reproducibility and bluish violet color reproducibility, and good light resistance.

When used for a non-contact fixing method, the combination of color toners can produce color images having better image qualities than conventional color toners, but the image qualities of the color images are inferior to those of the color images fixed by a roller fixing method.

As a result of the present inventor's investigation, it is found that if the yellow toner image has the lowest position in color toner images overlaid on a receiving material (i.e., color toner images are formed such that the yellow toner image contacts the receiving material), the image qualities are as good as those of the color toner images fixed by a roller fixing method.

Specific examples of the benzimidazolone pigments for use in the yellow toner of the present invention include the compound having the following formula (2):

(2)

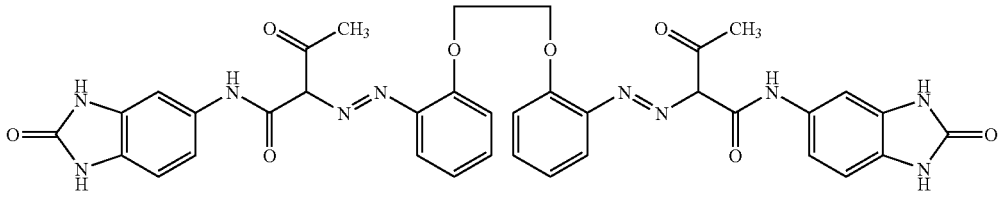

Specific examples of the β copper phthalocyanine for use in the cyan toner of the present invention include the compound having the following formula (3):

(3)

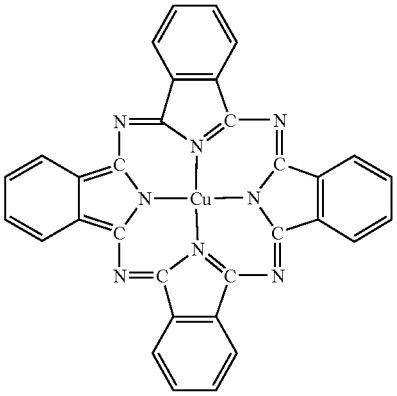

Naphthol Carmine F6B and Naphthol Carmine FBB for use in the magenta toner of the present invention have the following formula (4) and formula (5), respectively:

(4)

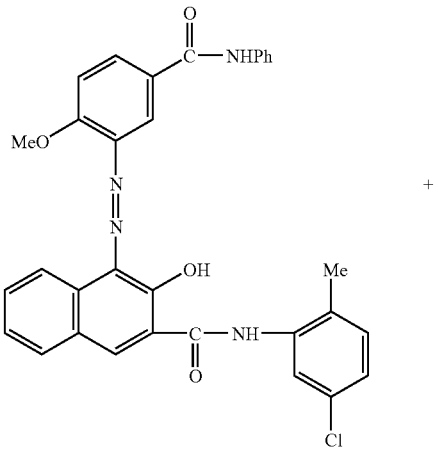

-continued

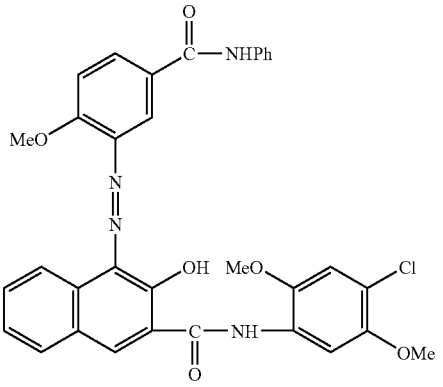

(mixture)

(5)

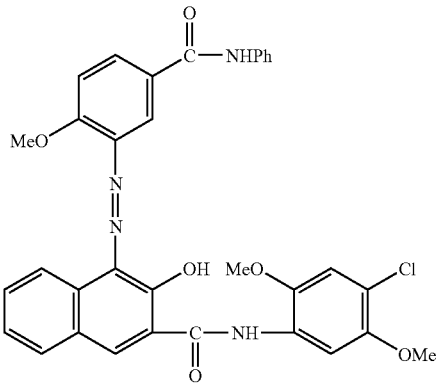

At this point, the mixing ratio of Naphthol Carmine F6B to Naphthol Carmine FBB (i.e., F6B/FBB) is preferably from 100/0 to 40/60 to produce images having good bluish violet color reproducibility.

In the present invention, a black toner may be used together with the color toners.

When a black toner is used for forming full color images, the black toner preferably includes a carbon black as the pigment.

The color toners of the present invention preferably have a relatively low haze factor when the toners are processed so as to be a thin layer because the resultant toner image has good color reproducibility. Specifically, when a thin toner layer having a weight of 8 g/m$^2$ is formed, the toner layer preferably has a haze factor not greater than 20%, and more preferably not greater than 15%. At this point, the thin toner layer is formed by coating a liquid, which is prepared by dissolving the toner with tetrahydrofuran, on a PET film, and then drying the coated liquid. Haze factor can be measured by a direct-reading type Haze Computer manufactured by Suga Test Instruments Co., Ltd.

In order to prepare a toner which can produce a toner image having a relatively low haze factor, a toner manufacturing method using a master batch in which a pigment is dispersed in a binder resin in a high content is preferably used. In order to prepare a master batch of a toner, flashing methods in which an aqueous cake including a pigment is mixed with a resin in a flasher, or kneading methods in which a pigment is kneaded with a resin using a two-roll or three-roll mill can be preferably used.

In order to obtain color images having good reproducibility, it is important that each of the color toners melts and uniformly mixes with each other when fixed. This mixing largely depends on the melt viscosity of the toners. The melt viscosity of the toners of the present invention is preferably not greater than 120 mPas·sec at 140° C. In the present invention, the melt viscosity is measured by a constant temperature method using a flow tester model CFT-500 manufactured by Shimazu Corp., under conditions that the diameter of a dice used is 1 mm, and the pressure is 20 Kg/cm$^2$.

In the color toners of the present invention, known binder resins can be used for the binder resin.

Specific examples of the binder resins for use in the toners include styrene polymers and substituted styrene polymers such as polystyrene, poly-p-chlorostyrene, polyvinyltoluene and the like; styrene copolymers such as styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinylmethylketone copolymers, styrene-butadiene copolymers, styrene-isoprene copolymers, styrene-acrylonitrile-indene copolymers, styrene-maleic acid copolymers, styrene-maleic acid ester copolymers and the like; and other resins such as polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosin, terpene resins, aliphatic or alicyclic hydrocarbon resins, aromatic petroleum resins and the like. These resins are used alone or in combination.

In order to prepare toners having good color reproducibility, the toners preferably include as a binder resin a polyol resin which includes a polyoxyalkylene chain as a main chain and which is prepared by reacting at least (a) an epoxy resin, (b) a dihydric phenol compound and (c) an adduct of a dihydric phenol compound with an alkylene oxide or its glycidyl ether compound.

Specific examples of such epoxy resins include epoxy resins which are prepared by reacting a bisphenol compound such as bisphenol A and bisphenol F with epichlorohydrin. Specific examples of the dihydric phenol compound include bisphenol A, bisphenol F and the like. Specific examples of the adducts of a dihydric phenol compound with an alkylene oxide include reaction products of ethylene oxide, propylene oxide, butylene oxide or a mixture thereof with a bisphenol compound such as bisphenol A or bisphenol F. The reaction products may be further reacted with epichlorohydrin or β-methylepichlorohydrin to prepare a glycidyl ether compound thereof. In addition, a monohydric phenol compound such as phenol, cresol, isopropyl phenol, aminophenol, octyl phenol, nonyl phenol, dodecyl phenol, p-cumyl phenol and the like may be reacted therewith.

The toners of the present invention may include a charge controlling agent, if desired. Specific examples of the charge controlling agent include known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, activators including fluorine, and the like.

In the present invention, aromatic hydroxycarboxylic acid derivatives including a metal such as zinc, chromium, cobalt, aluminum, iron, zirconium and the like are preferably used as the charge controlling agent. Among these aromatic hydroxycarboxylic acid derivatives, compounds having the following formula (1) are more preferable.

(1)

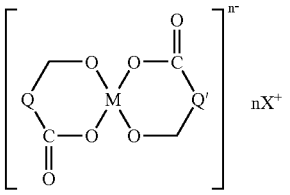

wherein Q and Q' independently represent an aromatic oxycarboxylic acid group which is optionally substituted with an alkyl and/or an aralkyl group; X represents a counter ion; and M represents a metal.

Among these aromatic hydroxycarboxylic acid derivatives, zinc or chromium salts of aromatic hydroxycarboxylic acid derivatives are most preferable because the resultant toners have good color reproducibility and good charge properties.

Specific examples of the metal salts of aromatic hydroxycarboxylic acid derivatives include the compounds having the following formula (6) or (7).

(6)

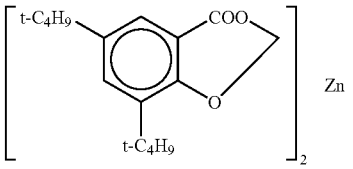

(7)

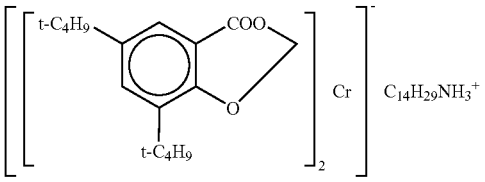

In the present invention, the content of the charge controlling agent in the toner is determined depending on species of the binder resin used, whether or not other additives are added thereto, and the method used for manufacturing the toner.

Preferably, the content of the charge controlling agent is from 0.1 to 10 parts by weight, and more preferably from 2 to 5 parts by weight, per 100 parts by weight of the binder resin.

When the content of the charge controlling agent is less than 0.1 parts, the resultant toner has insufficient charge quantity. In contrast, when the content is greater than 10 parts, the resultant toner has too large charge quantity, resulting in decrease of fluidity of the toner and image density of the resultant toner images.

In the present invention, the charge controlling agents can be used alone or in combination.

The toners of the present invention may include other additives. Specific examples of such additives include colloidal silica, hydrophobic silica, metal salts of fatty acids such as zinc stearate, aluminum stearate and the like; metal oxides such as titanium oxide, aluminum oxide, tin oxide, antimony oxide and the like; fluorine containing polymers and the like. Among these additives, hydrophobic silica, hydrophobic titania and hydrophobic alumina are preferable.

Specific examples of the hydrophobic silica include HDK H 2000, HDK H 2000/4, HDK H 2050EP, and HVK21, which are manufactured by Clariant Japan K.K.; and R972, R974, RX200, RY200, R202, R805, and R812, which are manufactured by Nippon Aerosil Co.

Specific examples of the titania include P-25 which is manufactured by Nippon Aerosil Co.; STT-30 and STT-65C-S, which are manufactured by Titan Kogyo K.K.; TAF-140, which is manufactured by Fuji Titanium Industry Co., Ltd.; and MT-150W, MT-500B, and MT-600B, which are manufactured by Tayca Corp. Specific examples of the titanium oxides, which are subjected to a hydrophobic treatment, include T-805, which is manufactured by Nippon Aerosil Co.; STT-30A and STT-65S-S, which are manufactured by Titan Kogyo K.K.; TAF-500T and TAF-1500T, which are manufactured by Fuji Titanium Industry Co., Ltd.; MT-100S and MT-100T, which are manufactured by Tayca Corp.; and IT-S, which is manufactured by Ishihara Sangyo Kaisha Ltd.

Hydrophobic silica, titania and alumina can also be prepared by treating hydrophilic silica, titania and alumina with a silane coupling agent such as methyltrimethoxy silane, methyltriethoxy silane, octyltrimethoxy silane and the like, or a silicone oil.

The toner of the present invention can be used for developing method using a one-component developer, in which a toner serving as a one-component developer is used for developing electrostatic latent images, and developing methods using a two-component developer, in which a developer consisting of a toner and a carrier is used for developing electrostatic latent images.

Carriers for use in combination with the toners of the present invention in two-component developers include known carrier materials such as iron powders, ferrite powder, glass beads and the like. These carriers may be coated with a resin such as polyfluorocarbons, polyvinyl chloride, polyvinylidene chloride, phenolic resins, polyvinyl acetal resins, silicone resins and the like.

In the present invention, the mixing ratio of the toner to the carrier in two-component developers is 0.5/100 to 10/100 by weight.

Figure 4:
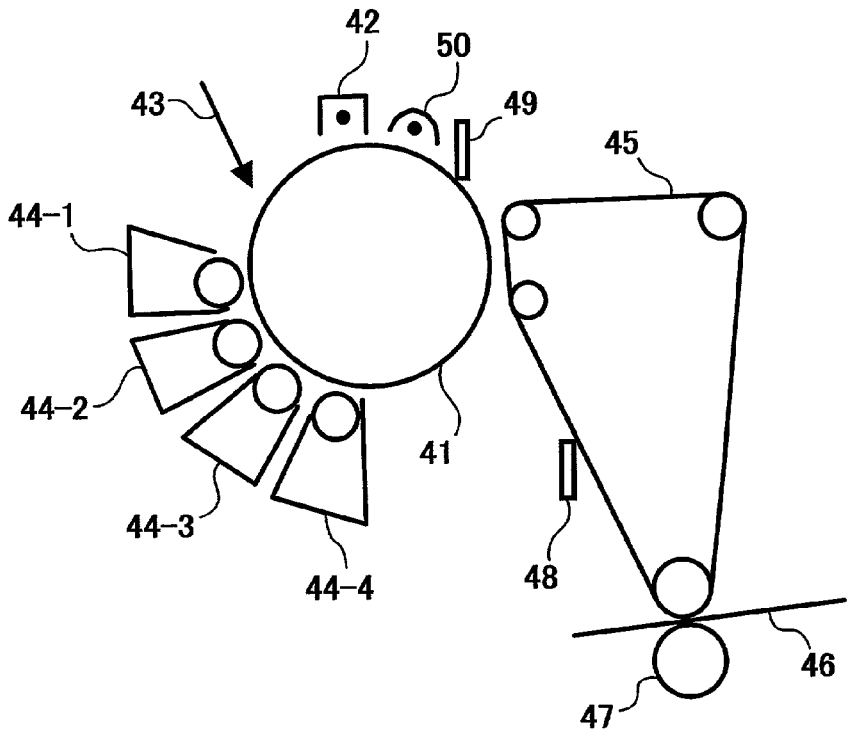
FIG. 4 is a schematic view illustrating the main structure of an image forming apparatus useful for the image forming method of the present invention.

FIG. 4 is a schematic view illustrating an image forming apparatus for use in the image forming method of the present invention. A photoreceptor 41 is charge by a charger 42 such that the surface of the photoreceptor 41 is entirely charged. The photoreceptor 41 is then exposed to imagewise light 43 to form an electrostatic latent image thereon. The electrostatic latent image is then developed by one of developing sections 44-1 to form a color toner image on the photoreceptor 41. The color toner image is then transferred on an intermediate transfer medium 45 while the intermediate transfer medium is contacted with the color toner image and rotated. The surface of the photoreceptor 41 is cleaned by a cleaner 49 to remove toner particles remaining on the surface of the photoreceptor 41. Then a discharging lamp 50 irradiates the photoreceptor 41 with light to remove the charge remaining on the photoreceptor 41.

The another color toner image is formed on the photoreceptor 41 by repeating the above-mentioned procedure except that a developing section 44-2 including a different color developer is used, The thus prepared color toner image is then transferred on the previously formed color image on the intermediate transfer medium 45. Similarly, other color toner images formed using developing sections 44-3 and 44-4 are formed on the photoreceptor 41 one by one. The color toner images are also transferred on the color images on the intermediate transfer medium 45. Thus a color image (for example, a full color image) is formed on the intermediate transfer medium 45.

The color image formed on the intermediate transfer medium 45 is then transferred on a receiving material 46 at once by a transfer roller 47. The intermediate transfer medium 45 is cleaned by a cleaner 48.

In the full color image forming method, plural image bearing members (e.g. at least three image bearing members, for development with at least the yellow toner, the magenta toner and the cyan toner, respectively) may be used to form the respective color toner image thereon. The plural color toner images are transferred on an intermediate transfer medium or a receiving material.

The intermediate transfer medium is not necessarily needed. The toner images formed on the image bearing member may be directly transferred one by one onto the receiving material.

Suitable non-contact fixing methods include oven fixing methods in which hot air is supplied to toner images on a receiving material to melt and fix the toner images, and radiation heat methods in which light such as infrared light is radiated to toner images to melt and fix the toner images.

Figure 5:
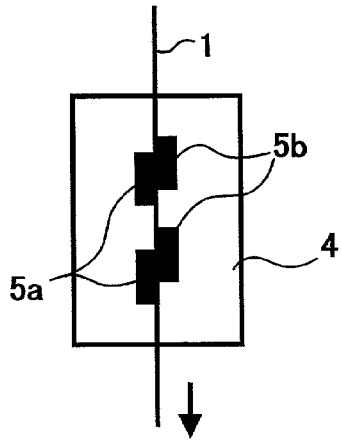
FIG. 5 is a schematic view illustrating an embodiment of the non-contact heat fixing device for use in the present invention.

FIG. 5 is a schematic view illustrating an embodiment of the non-contact heat fixing device (i.e., an oven fixing method) for use in the image forming method of the present invention. As shown in FIG. 5, a receiving material 1 having toner images 5*a* and 5*b* thereon is fed through an oven 4 in a direction indicated by an arrow. The toner images 5*a* and 5*b* do not contact the fixing device such as heating roller. The toner images 5*a* and 5*b* may be heated by a heat roller after the toner images 5*a* and 5*b* are fixed by the fixing oven 4.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Toner Manufacturing Example 1

Black Toner 1

The following components were mixed with a flasher.

| | |
|---|---|
| Water | 1200 |
| Phthalocyanine green aqueous cake (solid content of 30%) | 200 |
| Carbon black (tradenamed as MA60 and manufactured by Mitsubishi Chemical Corp.) | 540 |

One thousand and two hundred (1200) parts of a polyester resin having an acid value of 3 mgKOH/g, a hydroxy value of 25 mgKOH/g, a number average molecular weight Mn of 45000, a ratio Mw/Mn of 4.0 and a glass transition temperature of 60° C. were added to the mixture, and the mixture was kneaded at 150° C. for 30 minutes. After kneading, 1000 parts of xylene were added to the kneaded mixture, and the mixture was further kneaded for 1 hour. Water and xylene were then removed therefrom, and the mixture was cooled by rolling and pulverized with a pulverizer. Thus, a master batch pigment was prepared.

The following components were mixed, and then melted and kneaded with a two-roll mill.

| | |
|---|---|
| The polyester resin mentioned above | 100 |
| Master batch pigment prepared above | 5 |
| Compound having formula (6) (Charge controlling agent) | 4 |

The kneaded mixture was cooled by rolling, and then pulverized and classified. Thus, mother particles of a black toner having a volume average particle diameter of 7.5 μm were prepared. In addition, a hydrophobic silica (H2000, manufactured by Clariant Japan K.K.) was added thereto in an amount of 0.5% by weight, and then the mixture was mixed with a mixer to prepare a black toner 1. The haze factor of a thin layer of black toner 1 having a weight of 8 g/m$^2$ was 16%, and the melt viscosity of the toner was 96 mPas·sec at 140° C.

Yellow Toner 1

The following components were mixed with a flasher.

| | |
|---|---|
| Water | 600 |
| Aqueous cake of pigment having formula (2) (solid content of 50%) | 1200 |

One thousand and two hundred (1200) parts of the polyester resin for use in black toner 1 were added to the mixture, and the mixture was kneaded at 150° C. for 30 minutes. After kneading, 1000 parts of xylene were added to the kneaded mixture, and the mixture was further kneaded for 1 hour. Water and xylene were then removed therefrom, and the mixture was cooled by rolling and pulverized with a pulverizer. In addition, the mixture was passed through a three-roll mill twice. Thus, a master batch pigment was prepared.

The following components were mixed, and then melted and kneaded with a two-roll mill.

| | |
|---|---|
| The polyester resin for use in black toner 1 | 100 |
| Master batch pigment prepared above | 5 |
| Compound having formula (6) (Charge controlling agent) | 4 |

The kneaded mixture was cooled by rolling, and then pulverized and classified. Thus, mother particles of a yellow toner having a volume average particle diameter of 10 μm were prepared. In addition, a hydrophobic silica (H2000, manufactured by Clariant Japan K.K.) was added thereto in an amount of 0.5% by weight, and then the mixture was mixed with a mixer to prepare a yellow toner 1. The haze factor of a thin layer of yellow toner 1 having a weight of 8 g/m$^2$ was 17%, and the melt viscosity of the toner was 98 mPas·sec at 140° C.

Magenta Toner 1

The following components were mixed with a flasher.

| | |
|---|---|
| Water | 600 |
| Aqueous cake of pigment having formula (4) (solid content of 50%) | 1200 |

One thousand and two hundred (1200) parts of the polyester resin for use in black toner 1 were added to the mixture, and the mixture was kneaded at 150° C. for 30 minutes. After kneading, 1000 parts of xylene were added to the kneaded mixture, and the mixture was further kneaded for 1 hour. Water and xylene were then removed therefrom, and the mixture was cooled by rolling and pulverized with a pulverizer. In addition, the mixture was passed through a three-roll mill twice. Thus, a master batch pigment was prepared.

The following components were mixed, and then melted and kneaded with a two-roll mill.

| | |
|---|---|
| The polyester resin for use in black toner 1 | 100 |
| Master batch pigment prepared above | 5 |
| Compound having formula (6) (Charge controlling agent) | 4 |

The kneaded mixture was cooled by rolling, and then pulverized and classified. Thus, mother particles of a magenta toner having a volume average particle diameter of 10 μm were prepared. In addition, a hydrophobic silica (H2000, manufactured by Clariant Japan K.K.) was added thereto in an amount of 0.5% by weight, and then the mixture was mixed with a mixer to prepare a magenta toner 1. The haze factor of a thin layer of magenta toner 1 having a weight of 8 g/m$^2$ was 18%, and the melt viscosity of the toner was 17 mPas·sec at 140° C.

Cyan Toner 1

The following components were mixed with a flasher.

| | |
|---|---|
| Water | 600 |
| Aqueous cake of pigment having formula (3) (solid content of 50%) | 1200 |

One thousand and two hundred (1200) parts of the polyester resin for use in black toner 1 were added to the mixture, and the mixture was kneaded at 150° C. for 30 minutes. After kneading, 1000 parts of xylene were added to the kneaded mixture, and the mixture was further kneaded for 1 hour. Water and xylene were then removed therefrom, and the mixture was cooled by rolling and pulverized with a pulverizer. In addition, the mixture was passed through a three-roll mill twice. Thus, a master batch pigment was prepared.

The following components were mixed, and then melted and kneaded with a two-roll mill.

| | |
|---|---|
| The polyester resin for use in black toner 1 | 100 |
| Master batch pigment prepared above | 3 |
| Compound having formula (6) (Charge controlling agent) | 4 |

The kneaded mixture was cooled by rolling, and then pulverized and classified. Thus, mother particles of a cyan toner having a volume average particle diameter of 10 μm were prepared. In addition, a hydrophobic silica (tradenamed as H2000 and manufactured by Clariant Japan K.K.) was added thereto in an amount of 0.5% by weight, and then the mixture was mixed with a mixer to prepare a cyan toner 1. The haze factor of a thin layer of cyan toner 1 having a weight of 8 g/m$^2$ was 15%, and the melt viscosity of the toner was 34 mPas·sec at 140° C.

Toner Manufacturing Example 2

Black Toner 2

The following components were mixed with a mixer, and then kneaded 5 times with a three-roll mill.

| | |
|---|---|
| Carbon black (tradenamed as MA60 and manufactured by Mitsubishi Chemical Corp.) | 800 |
| Polyol resin (A) (number average molecular weight of 3800, Mw/Mn of 4.2, and glass transition temperature of 60° C.) | 1200 |

The mixture was cooled by rolling, and then pulverized with a pulverizer. Thus, a master batch pigment was prepared.

The following components were mixed, and then melted and kneaded with a two-roll mill.

| | |
|---|---|
| Polyol resin (A) | 100 |
| Master batch pigment prepared above | 6 |
| Compound having formula (7) (Charge controlling agent) | 3 |

The kneaded mixture was cooled by rolling, and then pulverized and classified. Thus, mother particles of a black toner having a volume average particle diameter of 7.5 μm were prepared. In addition, a hydrophobic silica (H2000, manufactured by Clariant Japan K.K.) was added thereto in an amount of 0.5% by weight, and then the mixture was mixed with a mixer to prepare a black toner 2. The haze factor of a thin layer of black toner 2 having a weight of 8 g/m$^2$ was 14%, and the melt viscosity of the toner was 88 mPas·sec at 140° C.

Yellow Toner 2

The following components were mixed with a mixer, and then kneaded 5 times with a three-roll mill.

| | |
|---|---|
| Pigment having formula (2) | 800 |
| Polyol resin (A) | 1200 |

The mixture was cooled by rolling, and then pulverized with a pulverizer. Thus, a master batch pigment was prepared.

The following components were mixed, and then melted and kneaded with a two-roll mill.

| | |
|---|---|
| Polyol resin (A) | 100 |
| Master batch pigment prepared above | 6 |
| Compound having formula (7) (Charge controlling agent) | 3 |

The kneaded mixture was cooled by rolling, and then pulverized and classified. Thus, mother particles of a yellow toner having a volume average particle diameter of 10 μm were prepared. In addition, a hydrophobic silica (H2000, manufactured by Clariant Japan K.K.) was added thereto in an amount of 0.5% by weight, and then the mixture was mixed with a mixer to prepare a yellow toner 2. The haze factor of a thin layer of yellow toner 2 having a weight of 8 g/m$^2$ was 15%, and the melt viscosity of the toner was 91 mPas·sec at 140° C.

Magenta Toner 2

The following components were mixed with a mixer, and then kneaded 5 times with a three-roll mill.

| | |
|---|---|
| Pigment having formula (4) | 400 |
| Pigment having formula (5) | 400 |
| Polyol resin (A) | 1200 |

The mixture was cooled by rolling, and then pulverized with a pulverizer. Thus, a master batch pigment was prepared.

The following components were mixed, and then melted and kneaded with a two-roll mill.

| | |
|---|---|
| Polyol resin (A) | 100 |
| Master batch pigment prepared above | 6 |
| Compound having formula (7) (Charge controlling agent) | 3 |

The kneaded mixture was cooled by rolling, and then pulverized and classified. Thus, mother particles of a magenta toner having a volume average particle diameter of 10 μm were prepared. In addition, a hydrophobic silica (H2000, manufactured by Clariant Japan K.K.) was added thereto in an amount of 0.5% by weight, and then the mixture was mixed with a mixer to prepare a magenta toner 2. The haze factor of a thin layer of magenta toner 2 having a weight of 8 g/m$^2$ was 14%, and the melt viscosity of the toner was 86 mPas·sec at 140° C.

Cyan Toner 2

The following components were mixed with a mixer, and then kneaded 5 times with a three-roll mill.

| | |
|---|---|
| Pigment having formula (3) | 800 |
| Polyol resin (A) | 1200 |

The mixture was cooled by rolling, and then pulverized with a pulverizer. Thus, a master batch pigment was prepared.

The following components were mixed, and then melted and kneaded with a two-roll mill.

| | |
|---|---|
| Polyol resin (A) | 100 |
| Master batch pigment prepared above | 5 |
| Compound having formula (7) (Charge controlling agent) | 4 |

The kneaded mixture was cooled by rolling, and then pulverized and classified. Thus, mother particles of a cyan toner having a volume average particle diameter of 10 μm were prepared. In addition, a hydrophobic silica (H2000, manufactured by Clariant Japan K.K.) was added thereto in an amount of 0.5% by weight, and then the mixture was mixed with a mixer to prepare a cyan toner 2. The haze factor of a thin layer of cyan toner 2 having a weight of 8 g/m$^2$ was 12%, and the melt viscosity of the toner was 87 mPas·sec at 140° C.

Toner Manufacturing Example 3

Black Toner 3

The following components were mixed with a mixer, and then kneaded 5 times with a three-roll mill.

| | |
|---|---|
| Carbon black (tradenamed as MA60 and manufactured by Mitsubishi Chemical Corp.) | 800 |
| Polyol resin (B) (number average molecular weight of 5600, Mw/Mn of 5.8, and transition temperature of 63° C.) | 1200 |

The mixture was cooled by rolling, and then pulverized with a pulverizer. Thus, a master batch pigment was prepared.

The following components were mixed, and then melted and kneaded with a two-roll mill.

| | |
|---|---|
| Polyol resin (B) | 100 |
| Master batch pigment prepared above | 6 |
| Compound having formula (7) (Charge controlling agent) | 3 |

The kneaded mixture was cooled by rolling, and then pulverized and classified. Thus, mother particles of a black toner having a volume average particle diameter of 7.5 μm were prepared. In addition, a hydrophobic silica (tradenamed as H2000 and manufactured by Clariant Japan K.K.) was added thereto in an amount of 0.5% by weight, and then the mixture was mixed with a mixer to prepare a black toner 3. The haze factor of a thin layer of black toner 2 having a weight of 8 g/m$^2$was 19%, and the melt viscosity of the toner was 125 mPas·sec at 140° C.

Yellow Toner 3

The following components were mixed with a mixer, and then kneaded 5 times with a three-roll mill.

| | |
|---|---|
| Pigment having formula (2) | 800 |
| Polyol resin (B) | 1200 |

The mixture was cooled by rolling, and then pulverized with a pulverizer. Thus, a master batch pigment was prepared.

The following components were mixed, and then melted and kneaded with a two-roll mill.

| | |
|---|---|
| Polyol resin (B) | 100 |
| Master batch pigment prepared above | 6 |
| Compound having formula (7) (Charge controlling agent) | 3 |

The kneaded mixture was cooled by rolling, and then pulverized and classified. Thus, mother particles of a yellow toner having a volume average particle diameter of 10 μm were prepared. In addition, a hydrophobic silica (tradenamed as H2000 and manufactured by Clariant Japan K.K.) was added thereto in an amount of 0.5% by weight, and then the mixture was mixed with a mixer to prepare a yellow toner 3. The haze factor of a thin layer of yellow toner 3 having a weight of 8 g/m$^2$ was 19%, and the melt viscosity of the toner was 121 mPas·sec at 140° C.

Magenta Toner 3

The following components were mixed with a mixer, and then kneaded 5 times with a three-roll mill.

| | |
|---|---|
| Pigment having formula (4) | 400 |
| Pigment having formula (5) | 400 |
| Polyol resin (B) | 1200 |

The mixture was cooled by rolling, and then pulverized with a pulverizer. Thus, a master batch pigment was prepared.

The following components were mixed, and then melted and kneaded with a two-roll mill.

| | |
|---|---|
| Polyol resin (B) | 100 |
| Master batch pigment prepared above | 6 |
| Compound having formula (7) (Charge controlling agent) | 3 |

The kneaded mixture was cooled by rolling, and then pulverized and classified. Thus, mother particles of amagenta toner having a volume average particle diameter of 10 μm were prepared. In addition, a hydrophobic silica (tradenamed as H2000 and manufactured by Clariant Japan K.K.) was added thereto in an amount of 0.5% by weight, and then the mixture was mixed with a mixer to prepare a magenta toner 3. The haze factor of a thin layer of magenta toner 3 having a weight of 8 g/m$^2$ was 18%, and the melt viscosity of the toner was 123 mPas·sec at 140° C.

Cyan Toner 3

The following components were mixed with a mixer, and then kneaded 5 times with a three-roll mill.

| | |
|---|---|
| Pigment having formula (3) | 800 |
| Polyol resin (B) | 1200 |

The mixture was cooled by rolling, and then pulverized with a pulverizer. Thus, a master batch pigment was prepared.

The following components were mixed, and then melted and kneaded with a two-roll mill.

| | |
|---|---|
| Polyol resin (B) | 100 |
| Master batch pigment prepared above | 5 |
| Compound having formula (7) (Charge controlling agent) | 4 |

The kneaded mixture was cooled by rolling, and then pulverized and classified. Thus, mother particles of a cyan toner having a volume average particle diameter of 10 μm were prepared. In addition, a hydrophobic silica (H2000, manufactured by Clariant Japan K.K.) was added thereto in an amount of 0.5% by weight, and then the mixture was mixed with a mixer to prepare a cyan toner 3. The haze factor of a thin layer of cyan toner 3 having a weight of 8 g/m$^2$ was 16%, and the melt viscosity of the toner was 122 mPas·sec at 140° C.

Toner Manufacturing Example 4

Black Toner 4

The following components were mixed with a mixer, and then kneaded with a three-roll mill such that the mixture was passed through the three-roll mill twice.

| | |
|---|---|
| Carbon black (tradenamed as MA60 and manufactured by Mitsubishi Chemical Corp.) | 800 |
| Polyol resin (A) for use in black toner 2 | 1200 |

The mixture was cooled by rolling, and then pulverized with a pulverizer. Thus, a master batch pigment was prepared.

The following components were mixed, and then melted and kneaded with a two-roll mill.

| | |
|---|---|
| Polyol resin (A) | 100 |
| Master batch pigment prepared above | 6 |
| Compound having formula (7) (Charge controlling agent) | 3 |

The kneaded mixture was cooled by rolling, and then pulverized and classified. Thus, mother particles of a black toner having a volume average particle diameter of 7.5 μm were prepared. In addition, a hydrophobic silica (tradenamed as H2000 and manufactured by Clariant Japan.) was added thereto in an amount of 0.5% by weight, and then the mixture was mixed with a mixer to prepare a black toner 4. The haze factor of a thin layer of black toner 4 having a weight of 8 g/m$^2$was 21%, and the melt viscosity of the toner was 88 mPas·sec at 140° C.

Yellow Toner 4

The following components were mixed with a mixer, and then kneaded with a three-roll mill such that the mixture was passed through the three-roll mill twice.

| | |
|---|---|
| Pigment having formula (2) | 800 |
| Polyol resin (A) | 1200 |

The mixture was cooled by rolling, and then pulverized with a pulverizer. Thus, a master batch pigment was prepared.

The following components were mixed, and then melted and kneaded with a two-roll mill.

| | |
|---|---|
| Polyol resin (A) | 100 |
| Master batch pigment prepared above | 6 |
| Compound having formula (7) (Charge controlling agent) | 3 |

The kneaded mixture was cooled by rolling, and then pulverized and classified. Thus, mother particles of a yellow toner having a volume average particle diameter of 10 μm were prepared. In addition, a hydrophobic silica (tradenamed as H2000 and manufactured by Clariant Japan K.K.) was added thereto in an amount of 0.5% by weight, and then the mixture was mixed with a mixer to prepare a yellow toner 4. The haze factor of a thin layer of yellow toner 4 having a weight of 8 g/m$^2$ was 23%, and the melt viscosity of the toner was 91 mPas·sec at 140° C.

Magenta Toner 4

The following components were mixed with a mixer, and then kneaded with a three-roll mill such that the mixture was passed through the three-roll mill twice.

| | |
|---|---|
| Pigment having formula (4) | 400 |
| Pigment having formula (5) | 400 |
| Polyol resin (A) | 1200 |

The mixture was cooled by rolling, and then pulverized with a pulverizer. Thus, a master batch pigment was prepared.

The following components were mixed, and then melted and kneaded with a two-roll mill.

| | |
|---|---|
| Polyol resin (A) | 100 |
| Master batch pigment prepared above | 6 |
| Compound having formula (7) (Charge controlling agent) | 3 |

The kneaded mixture was cooled by rolling, and then pulverized and classified. Thus, mother particles of amagenta toner having a volume average particle diameter of 10 μm were prepared. In addition, a hydrophobic silica (H2000, manufactured by Clariant Japan K.K.) was added thereto in an amount of 0.5% by weight, and then the mixture was mixed with a mixer to prepare a magenta toner 4. The haze factor of a thin layer of magenta toner 4 having a weight of 8 g/m2 was 22%, and the melt viscosity of the toner was 89 mPas·sec at 140° C.

Cyan Toner 4

The following components were mixed with a mixer, and then kneaded with a three-roll mill such that the mixture was passed through the three-roll mill twice.

| | |
|---|---|
| Pigment having formula (3) | 800 |
| Polyol resin (A) | 1200 |

The mixture was cooled by rolling, and then pulverized with a pulverizer. Thus, a master batch pigment was prepared.

The following components were mixed, and then melted and kneaded with a two-roll mill.

| | |
|---|---|
| Polyol resin (A) | 100 |
| Master batch pigment prepared above | 5 |
| Compound having formula (7) (Charge controlling agent) | 4 |

The kneaded mixture was cooled by rolling, and then pulverized and classified. Thus, mother particles of a cyan toner having a volume average particle diameter of 10 μm were prepared. In addition, a hydrophobic silica (tradenamed as H2000 and manufactured by Clariant Japan K.K.) was added thereto in an amount of 0.5% by weight, and then the mixture was mixed with a mixer to prepare a cyan toner 4. The haze factor of a thin layer of cyan toner 4 having a weight of 8 g/m$^2$ was 19%, and the melt viscosity of the toner was 87 mPas·sec at 140° C.

Toner Manufacturing Example 5

The procedures for preparation of the black, yellow, magenta and cyan toner in Toner Manufacturing Example 1 were repeated except that the yellow pigment was replaced with 1200 parts of an aqueous cake of Pigment Yellow 17 (solid content of 50%), and the magenta pigment was replaced with 1200 parts of an aqueous cake of Pigment Red 57 aqueous cake (solid content of 50%). Thus, a black toner 5, a yellow toner 5, a magenta toner 5 and a cyan toner 5 were prepared. The haze factor of yellow toner 5 was 13%, and the melt viscosity thereof was 96 mPas·sec at 140° C. The haze factor of magenta toner 5 was 16%, and the melt viscosity thereof was 96 mPas·sec at 140° C.

Toner Manufacturing Example 6

The procedures for preparation of the black, yellow, magenta and cyan toner in Toner Manufacturing Example 2 were repeated except that the yellow pigment was replaced with 600 parts of Pigment Yellow 17, and the magenta pigment was replaced with 600 parts of Pigment Red 122. Thus, a black toner 6, a yellow toner 6, a magenta toner 6 and a cyan toner 6were prepared. The haze factor of yellow toner 6 was 12%, and the melt viscosity thereof was 84 mPas·sec at 140° C. The haze factor of magenta toner 6 was 16%, and the melt viscosity thereof was 89 mPas·sec at 140° C.

Carrier Manufacturing Example 1

The following components were mixed with a homomixer for 30 minutes to prepare a coating liquid for forming a coating layer on the surface of a carrier.

| | |
|---|---|
| Silicone resin solution (tradenamed as KR50 and manufactured by Shin-Etsu Chemical Co., Ltd) | 100 |
| Carbon black (tradenamed as BP2000 and manufactured by Cabot Corp.) | 3 |
| Toluene | 100 |

The coating liquid was coated on the surface of 1000 parts of a carrier, a spherical ferrite powder having an average particle diameter of 50 μm, using a fluidized bed type coating apparatus. Thus, a carrier A was prepared.

Example 1

Five (5) parts of each of the color toners prepared in Toner Manufacturing Example 1 were mixed with 95 parts of carrier A to prepare four color developers.

Yellow, magenta, cyan, red, green and blue color images were formed using a copier IBM 3170, which uses a non-contact heat fixing device as shown in FIG. 5, and the color developers. The values a*, and b* of the color images were measured with a spectrodensitometer X-Rite 938 (manufactured by X-Rite) are shown in Table 1. The values are also plotted in a*, and b* chromaticity coordinates in FIGS. 1, 2 and 3. At the red and green color images, the yellow toner layer was located below the magenta or cyan color image (i.e., the yellow color toner layer contacted the receiving material and the magenta or cyan color image was formed on the yellow toner layer).

Example 2

Five (5) parts of each of the color toners prepared in Toner Manufacturing Example 2 were mixed with 95 parts of carrier A to prepare four color developers.

Color images were produced and evaluated in the same way as performed in Example 1. The result is shown in Table 1 and FIGS. 1-3.

Example 3

Five (5) parts of each of the color toners prepared in Toner Manufacturing Example 3 were mixed with 95 parts of carrier A to prepare four color developers.

Color images were produced and evaluated in the same way as performed in Example 1. The result is shown in Table 1 and FIGS. 1-3.

Example 4

Five (5) parts of each of the color toners prepared in Toner Manufacturing Example 4 were mixed with 95 parts of carrier A to prepare four color developers.

Color images were produced and evaluated in the same way as performed in Example 1. The result is shown in Table 1 and FIGS. 1-3.

Comparative Example 1

The procedures for preparation and evaluation of the color toners in Example 1 were repeated except that at the red and green images, the yellow toner layer was formed on the magenta or cyan toner layer.

Figure 2:
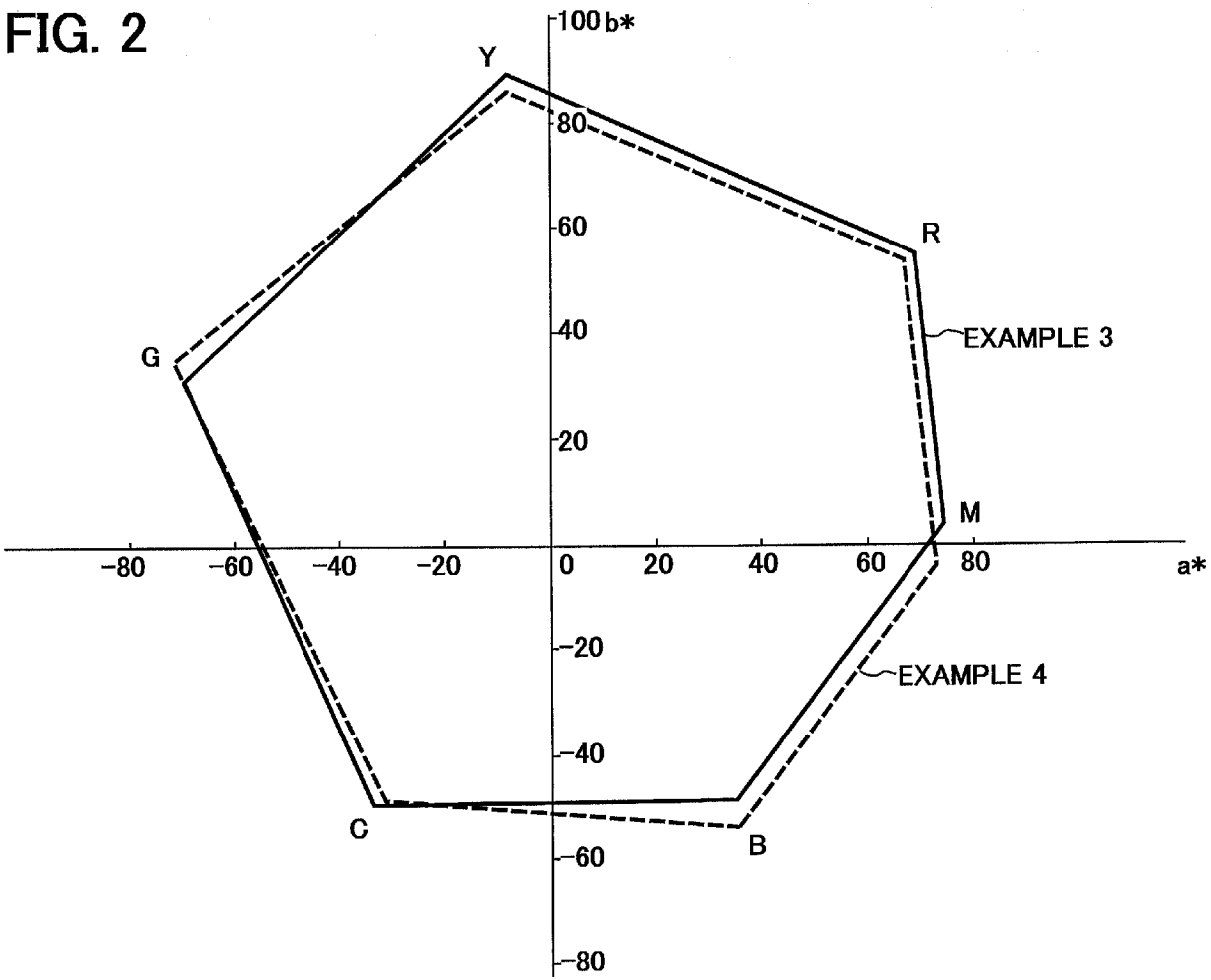
Figure 3:
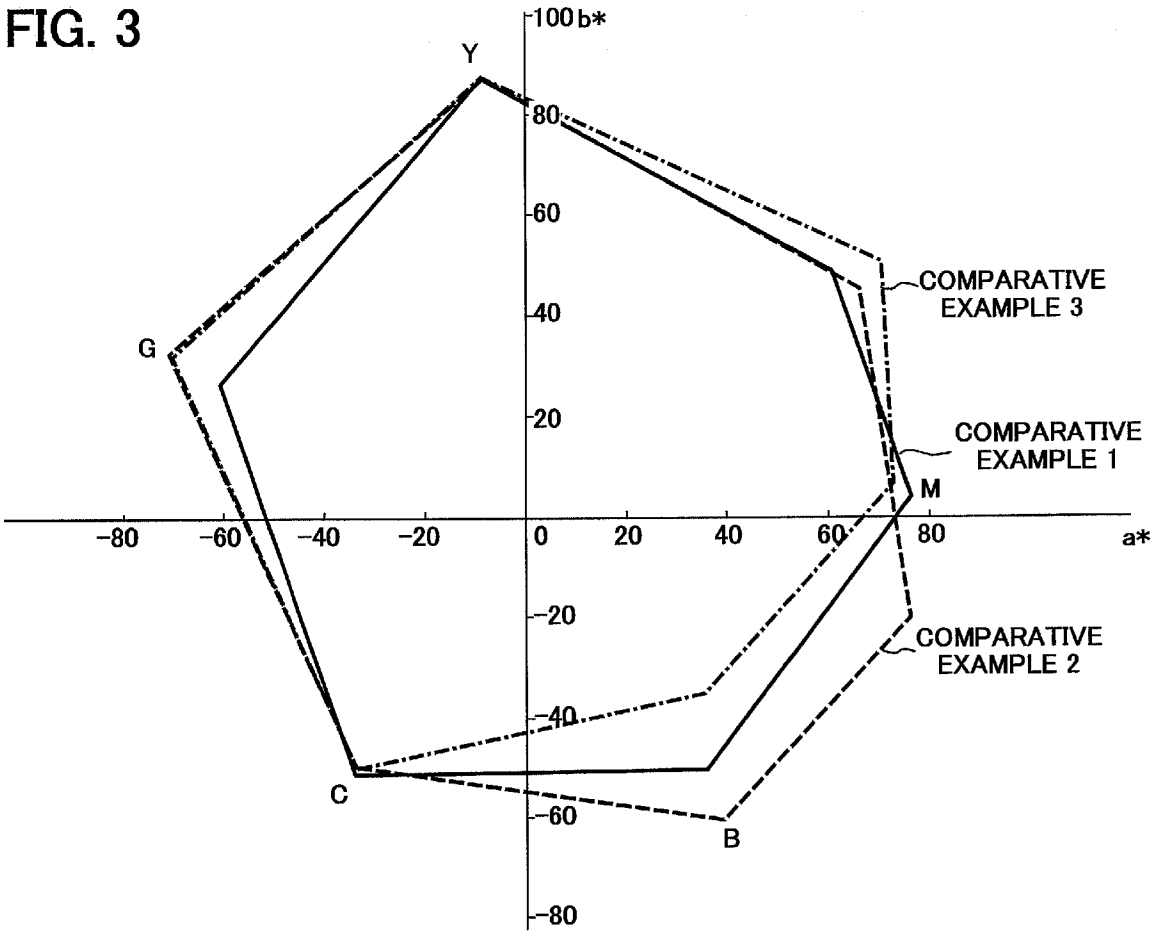

The result is shown in Table 1 and FIGS. 1-3.

Comparative Example 2

Five (5) parts of each of the yellow, magenta, and cyan color toners prepared in Toner Manufacturing Example 5 and the black toner prepared in Toner Manufacturing Example 1 were mixed with 95 parts of carrier A to prepare four color developers.

Color images were produced and evaluated in the same way as performed in Example 1. The result is shown in FIG. 1.

Comparative Example 3

Five (5) parts of each of the yellow, magenta, and cyan color toners prepared in Toner Manufacturing Example 6 and the black toner prepared in Toner Manufacturing Example 2 were mixed with 95 parts of carrier A to prepare four color developers.

Color images were produced and evaluated in the same way as performed in Example 1. The result is shown in Table 1 and FIGS. 1-3.

Evaluation of Toners

1. Color Tones

The values a*, and b* of the color images were measured with a spectrodensitometer X-Rite 938 (manufactured by X-Rite). The results are shown in Table 1. In addition, the values are plotted in a*, and b* chromaticity coordinates in FIGS. 1-3.

2. Light Resistance of Image

The images were exposed to sunlight for 15 days (15×24 hours), and the images were visually observed to determine whether the images faded.

As a result, the yellow and magenta images prepared in Comparative Example 2, and the yellow image prepared in Comparative Example 3 were faded. In addition, the color tones of the green and blue images prepared in Comparative Example 2 and the green image prepared in Comparative Example 3 changed. The color reproducibility of the red and green images in Example 1 was better than that of the images in Comparative Example 1.

TABLE 1

| | Color of image | a* | b* | | Color of image | A* | b* |
|---|---|---|---|---|---|---|---|
| Ex. 1 | Red | 71 | 57 | Comp. Ex. 1 | Red | 60.4 | 48.5 |
| | Magenta | 76 | 4 | | Magenta | 76.0 | 4.0 |
| | Blue | 36.0 | −50.0 | | Blue | 36.0 | −50.0 |
| | Cyan | −34.3 | −51.1 | | Cyan | −34.3 | −51.1 |
| | Green | −71 | 31.8 | | Green | −60.4 | 27.0 |
| | Yellow | −8.0 | 92.0 | | Yellow | −6.8 | 78.2 |
| Ex. 2 | Red | 69.0 | 54.0 | Comp. Ex. 2 | Red | 66.0 | 45.0 |
| | Magenta | 75.0 | −3.6 | | Magenta | 75.4 | −20.0 |
| | Blue | 36.0 | −53.0 | | Blue | 38.7 | −60.5 |
| | Cyan | −34.6 | −50.6 | | Cyan | −34.3 | −50.1 |
| | Green | −71.3 | 33.0 | | Green | −70.7 | 32.6 |
| | Yellow | −7.9 | 93.4 | | Yellow | −7.9 | 92.5 |
| Ex. 3 | Red | 68.2 | 54.7 | Comp. Ex. 3 | Red | 70.0 | 56.0 |
| | Magenta | 73.0 | 3.9 | | Magenta | 72.0 | 6.0 |
| | Blue | 34.6 | −48.0 | | Blue | 35.0 | −35.0 |
| | Cyan | −32.9 | −49.1 | | Cyan | −34.3 | −50.1 |
| | Green | −68.2 | 30.5 | | Green | −70.7 | 32.6 |
| | Yellow | −7.7 | 88.3 | | Yellow | −7.9 | 92.5 |
| Ex. 4 | Red | 67.0 | 53.0 | | | | |
| | Magenta | 72.0 | −3.6 | | | | |
| | Blue | 35.0 | −53.0 | | | | |
| | Cyan | −32.0 | −48.0 | | | | |
| | Green | −70.7 | 33.0 | | | | |
| | Yellow | −7.9 | 85.0 | | | | |

As explained above, by preparing a yellow toner including a benzimidazolone type pigment, a magenta toner including Naphthol Carmine F6B or a combination of Naphthol Carmine F6B and Naphthol Carmine FBB, and a cyan toner including β copper phthalocyanine, and producing color toner images in which the yellow toner layer is located below the magenta and cyan toner layer when the color toner layers are overlaid, the resultant color images have good color tone (i.e., the resultant color image has good color reproducibility of red and blue images), and good stability (i.e., good resistance to light).

In addition, when the toners have a haze factor not greater than 20%, the resultant toner images have better color reproducibility.

Further, when the color toners having a melt viscosity not greater than 120 mPas·sec at 140° C., the color reproducibility can be further improved because the color toner layers can be mixed with each other.

In addition, when the toners includes a specified polyol resin as a binder resin, the color reproducibility can be further improved.

Further, when the toner includes a specified aromatic hydroxycarboxylic acid metal salt as a charge controlling agent, the resultant toners have good charge properties and therefore can produce images having good image qualities such as good color reproducibility.

This document claims priority and contains subject matter related to Japanese Patent Application No. 2000-133980, filed on May 2, 2000, incorporated herein by reference.

Having now fully described the invention, it will be apparent to one of ordinary skill in the art that many changes and modifications can be made thereto without departing from the spirit and scope of the invention as set forth therein.

What is claimed is:

1. A method for forming a full color image, comprising:

forming at least a yellow color toner image, a magenta color toner image and a cyan color toner image on a receiving material to form a full color image thereon; and fixing the full color image upon application of heat thereto while not contacting the full color image, wherein the yellow, magenta and cyan color toner images are respectively formed by yellow, magenta and cyan color toners and each comprises a binder resin and a pigment, wherein the yellow color toner image comprises a benzimidazolone pigment, the magenta color toner image comprises at least one of Naphthol Carmine F6B and a combination of Naphthol Carmine F6B and Naphthol Carmine FBB, and the cyan color toner image comprises β copper phthalocyanine, wherein the yellow color toner image has a position closer to the receiving material than any other color toner image when two or more of the color toner images including the yellow color toner image are overlaid, wherein the color toners have a melt viscosity not greater than 120 mPas·sec at 140° C., and wherein each of the color toner images has a haze factor not greater than 20% when the color toner images have a weight of 8 g/m$^2$ and are fixed.

2. The method according to claim 1, wherein the binder resin comprises a polyol resin having a polyoxyalkylene moiety in a main chain thereof.

3. The method according to claim 2, wherein the polyol resin comprises a reaction product of (a) an epoxy resin; (b) a dihydric phenol; and either (c) an adduct of a dihydric phenol with an alkylene oxide or (c') a glycidyl ether of an adduct of a dihydric phenol with an alkylene oxide.

4. The method according to claim 1, wherein each of the color toners further comprises an aromatic hydrocarboxylic acid metal salt having the following formula (1):

(1)

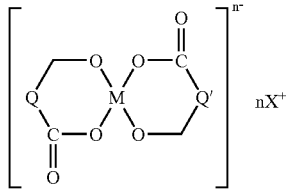

wherein Q and Q' independently represent an aromatic oxycarboxylic acid group which is optionally substituted by an alkyl group or an aralkyl group; X represents a counter ion; and M represents a metal.

5. The method according to claim 4, wherein the metal is zinc.

6. A method for forming a full color image, comprising:

forming at least a yellow color toner image, a magenta color toner image and a cyan color toner image on a receiving material to form a full color image thereon; and fixing the full color image upon application of heat thereto while not contacting the full color image, wherein the yellow, magenta and cyan color toner images are respectively formed by yellow, magenta and cyan color toners and each comprises a binder resin and a pigment, wherein the yellow color toner image comprises a benzimidazolone pigment, the magenta color toner image comprises at least one of Naphthol Carmine F6 B and a combination of Naphthol Carmine F6B and Naphthol Carmine FBB, and the cyan color toner image comprises β copper phthalocyanine, and wherein the yellow color toner image has a position closer to the receiving material than any other color toner image when two or more of the color toner images including the yellow color toner image are overlaid, wherein each of the color toner images has a haze factor not greater than 20% when the color toner images have a weight of 8 g/m$^2$ and are fixed; wherein the color toners have a melt viscosity not greater than 120 mPas·sec at 140° C.; wherein the binder resin comprises a polyol resin having a polyoxyalkylene moiety in a main chain thereof, said polyol resin comprising a reaction product of (a) an epoxy resin, (b) a dihydric phenol, and either (c) an adduct of a dihydric phenol with an alkylene oxide or (c') a glycidyl ether of an adduct of a dihydric phenol with an alkylene oxide; and wherein each of the color toners further comprises an aromatic hydrocarboxylic acid metal salt having the following formula (1):

(1)

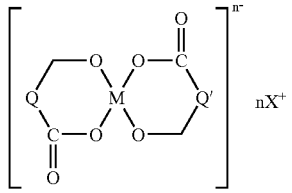

wherein Q and Q' independently represent an aromatic oxycarboxylic acid group which is optionally substituted by an alkyl group or an aralkyl group; X represents a counter ion; and M represents zinc.

* * * * *